US006807919B1

(12) United States Patent
Thomsen

(10) Patent No.: US 6,807,919 B1
(45) Date of Patent: Oct. 26, 2004

(54) MASTLESS KAYAK SAIL

(76) Inventor: Timothy Addis Thomsen, P.O. Box 2041 4876 Pear Point Rd., Friday Harbor, WA (US) 98250

( * ) Notice: Subject to any disclaimer, the term of this patent is extended or adjusted under 35 U.S.C. 154(b) by 0 days.

(21) Appl. No.: 10/695,085

(22) Filed: Oct. 27, 2003

(51) Int. Cl.[7] ..... B63B 35/79

(52) U.S. Cl. ..... 114/39.12; 114/39.22; 114/102.11; 114/102.13; 114/347

(58) Field of Search ..... 114/102.1, 102.11, 114/102.13, 102.29, 347, 39.11, 39.12, 39.16, 39.21, 39.22; 440/101; 280/810; 244/153 R, 155 R, 155 A

(56) References Cited

U.S. PATENT DOCUMENTS

| | | | | | |
|---|---|---|---|---|---|
| 137,190 | A | * | 3/1873 | Fleetwood | 114/311 |
| 302,517 | A | * | 7/1884 | Nelson | 280/810 |
| 611,829 | A | * | 10/1898 | Brown | 5/413 R |
| 2,213,754 | A | * | 9/1940 | Hans | 280/810 |
| 2,353,662 | A | * | 7/1944 | Goldman | 416/71 |
| 3,158,882 | A | * | 12/1964 | Kirby | 114/39.22 |
| 3,768,823 | A | * | 10/1973 | Goldberg | 280/810 |
| 4,130,292 | A | * | 12/1978 | Lorenz | 280/810 |
| 4,136,631 | A | * | 1/1979 | Nimchuk | 114/102.11 |
| 4,531,763 | A | * | 7/1985 | Toland | 280/810 |
| 4,533,159 | A | * | 8/1985 | Seidel | 280/810 |
| 4,612,870 | A | * | 9/1986 | Shewmon | 114/311 |
| 4,646,669 | A | | 3/1987 | Frank | |
| 4,854,572 | A | * | 8/1989 | Knight | 482/74 |
| 4,890,570 | A | | 1/1990 | Hofmeister | |
| 4,958,582 | A | | 9/1990 | Vermillion | |
| 5,060,590 | A | | 10/1991 | Springall | |
| 5,289,792 | A | | 3/1994 | Forrest | |
| 5,924,732 | A | * | 7/1999 | Olsen | 280/810 |
| 6,289,833 | B1 | * | 9/2001 | Kirk | 114/39.21 |
| 6,390,013 | B1 | | 5/2002 | Cornell | |
| 6,457,430 | B1 | | 10/2002 | Drabkin | |
| 6,615,758 | B2 | | 9/2003 | Blad | |
| 6,655,314 | B2 | * | 12/2003 | Housely et al. | 114/347 |

FOREIGN PATENT DOCUMENTS

| | | | | | |
|---|---|---|---|---|---|
| DE | 4217250 | A1 | * | 12/1993 | B63B/35/58 |
| FR | 2288025 | A | * | 6/1976 | B63B/7/00 |
| JP | 60252093 | A | * | 12/1985 | B63B/35/86 |
| WO | WO 8300311 | A | * | 2/1983 | A63C/15/00 |
| WO | WO 8801586 | A1 | * | 3/1988 | B63B/21/48 |

OTHER PUBLICATIONS

Alex Narvey, The Canadian Canoeing Companion, 1988, p. 18, Thunder Enlightening Press, Winnipeg, Manitoba, Canada.

* cited by examiner

*Primary Examiner*—S. Joseph Morano
*Assistant Examiner*—Ajay Vasudeva
(74) *Attorney, Agent, or Firm*—Andrew J. Estrada

(57) ABSTRACT

A mastless sail for use in a two-seat kayak is disclosed. The apparatus is designed with a boomstick feature for supporting and controlling the bottom of the sail. The existing kayak paddles support and control the top of the sail. The apparatus is also designed for fast assembly and disassembly. No alterations to the kayak are necessary.

3 Claims, 6 Drawing Sheets

MASTLESS KAYAK SAIL

CROSS-REFERENCES TO RELATED APPLICATIONS

Not Applicable.

STATEMENT REGARDING FEDERALLY SPONSORED RESEARCH OR DEVELOPMENT

Not Applicable.

REFERENCE TO A "SEQUENTIAL LISTING," A TABLE, OR A COMPUTER PROGRAM LISTING APPENDIX SUBMITTED ON A COMPACT DISC. SEE 37 CFR 1.52(e)(5)

Not Applicable.

BACKGROUND OF THE INVENTION (1) Field of the Invention

This invention relates to a sail for small watercraft, and more particularly, a mastless sail apparatus that enables a two-seat kayak to be propelled by the wind.

(2) Description of the Related Art Including Information Disclosed Under 37 CFR 1.97 and 1.98

Kayaks have been used for water transportation for centuries. One prominent feature of kayaks is the ease and efficiency with which kayaks can maneuver in tight areas by paddling. Because of their light weight and narrow beam, kayaks can be easily transported over land as well. More recently, kayaks have been designed to be wind-propelled by means of sail rigging. The kayak sail rigging of today normally requires, as do sailboats, a mast to support the sail structure. A sail apparatus with a mast and associated sail structure, however, frustrates the advantages of kayaks.

A mastless sailing apparatus has been used in canoes. This apparatus consisted of a groundsheet or poncho as sail material which was tied to tent poles and held by the bowman in a two-person canoe. The apparatus was only suitable for running with the wind because the bowman was limited to holding the tent poles in a nearly upright position. Because the tent poles and sail material were relatively shear, the apparatus could only safely be used in gentle breeze wind conditions. Also, the attachments of the sail material to the tent poles were only as good as the knots tied by the user of the apparatus. If the knots were not secured properly, the sail material could slide down the tent poles or even become unattached altogether. Furthermore, the groundsheet or poncho lacked a viewing window for safe navigation.

BRIEF SUMMARY OF THE INVENTION

The mastless kayak sail apparatus provides a structure in which a sail is attached to a boomstick along the bottom of the sail and to one shaft end of each of the two kayak paddles at the top corners of the sail. The means for attaching the sail to the boomstick and shaft ends of the paddles are designed for fast assembly and disassembly. A transparent viewing window is affixed within the sail for safe navigation.

One object of the present invention is to provide a mastless sail apparatus that is simple in design and easy to assemble and disassemble, yet rugged enough to operate under ordinary sailing conditions. Another object is to provide a sailing apparatus which requires no kayak alterations. Still another object is to provide such an apparatus that can sail in a direction other than downwind. A further object of the invention is to provide an apparatus which is conveniently stowed, yet ready for use when the occupants are paddling the kayak. These and further objects of the invention will be apparent from the following description of preferred embodiments thereof.

BRIEF DESCRIPTION OF THE SEVERAL VIEWS OF THE DRAWINGS

The invention will be further described in connection with the accompanying drawings, in which.

DETAILED DESCRIPTION OF THE INVENTION

Figure 1:
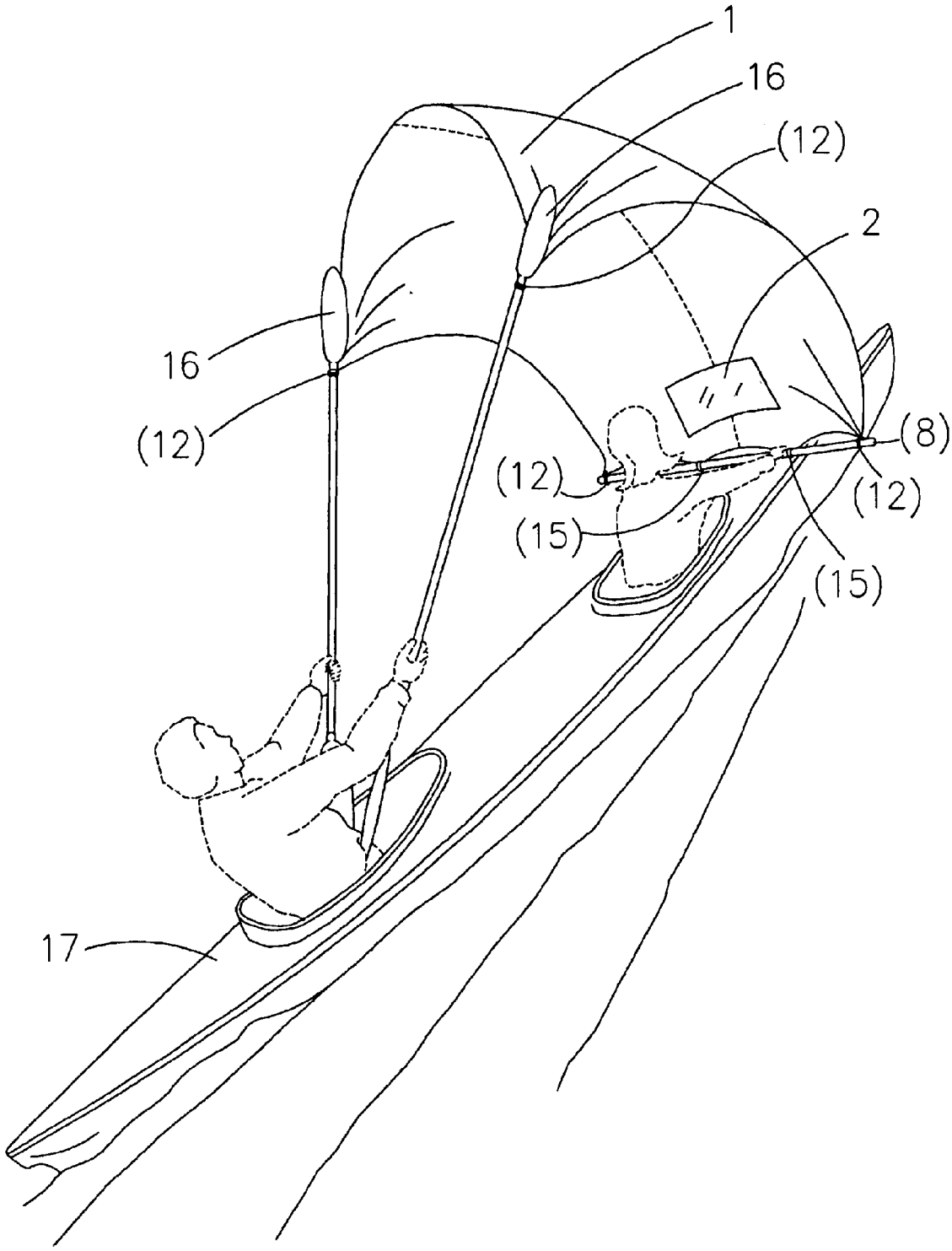
FIG. 1 is a perspective view of a kayak with the occupants using the fully assembled invention for wind propulsion.

FIG. 1 shows two occupants in a kayak 17 using the fully assembled preferred embodiment of the present invention. The invention includes a sail 1 with a transparent viewing window 2. Each top corner of the sail 1 is attached to one end of the shaft of each kayak paddle 16 with a securing assembly 12. The corners of bottom of the sail 1 are attached to the boomstick assembly 8 with securing assemblies 12. Closer to the middle of the bottom of the sail 1, the bottom of the sail 1 is additionally attached to the boomstick with Velcro strap assemblies 15. The occupant in the back seat of the kayak 17 holds the kayak paddles 16 facing forward at an angle of approximately 60° off the horizon as shown. The occupant in the back seat of the kayak 17 should also hold the paddles 16 about five to six feet apart as measured from the top of one paddle 16 to that of the other paddle 16. At the same time the occupant in the front seat of the kayak 17 holds the boomstick assembly 8 in front of herself as shown. The occupant in the front seat may sail up to 45° off the wind by angling the boomstick assembly 8 to the left or right so that the wind fills the inside of the sail 1. The course is maintained by the occupant in the back seat who steers by foot-pedal rudder control (not shown). Foot-pedal rudder controls are standard equipment on almost every double kayak model. The occupant in the back seat may change the height of the sail by raising or lowering the paddles 16 from the normal operating position of 60° off the horizon. The occupant in the back seat may also change the width of the sail by either bringing the paddles 16 closer together (narrowing) or by spreading the paddles 16 apart (widening). The sail 1 billows most like a spinnaker when the paddles 16 are brought together and lowered to an angle less than 60° off the horizon. In this mode of operation, a greater differential of air pressure between the leeward and windward sides of the sail 1 is achieved. Consequently, the kayak may attain greater sailing speeds. In heavier wind conditions where control of sailing speed is more important, the occupant in the back seat may raise and separate the paddles 16 simultaneously. The occupant in the back seat may use any variation of sail height and width to achieve the desired control or speed of the kayak.

Figure 2:
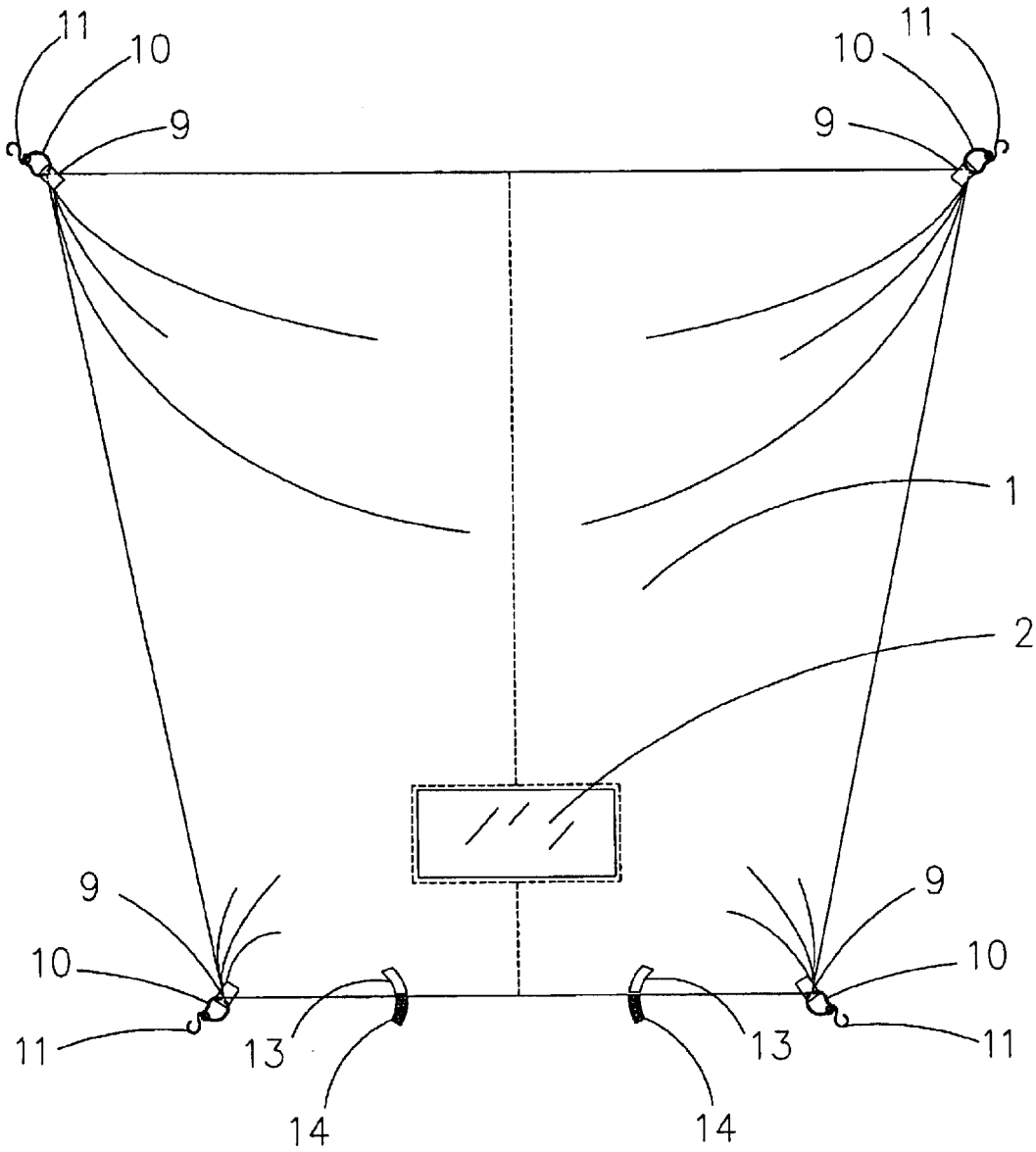
FIG. 2 is a top perspective view of the sail of the preferred embodiment, including the transparent viewing window, two Velcro strap assemblies toward the middle of the bottom of the sail, and securing assemblies on all four corners of the sail.
Figure 5:
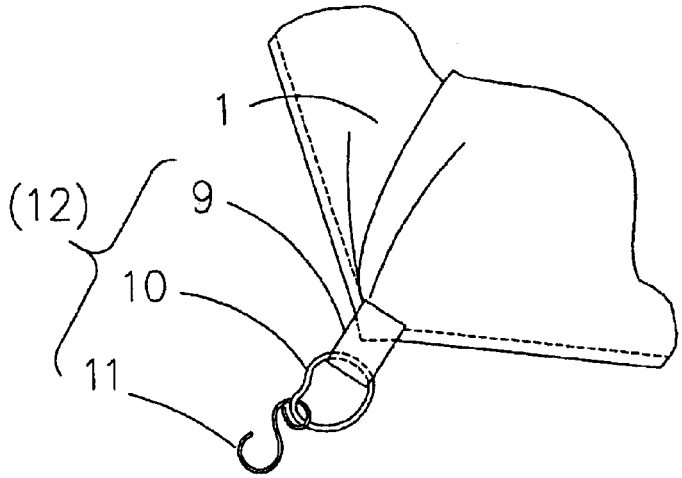
FIG. 5 is a detailed perspective view of a securing assembly at one of the corners of the bottom of the sail including a sewn-on fabric loop, a nylon-covered elastic band, and a securing hook.
Figure 8:
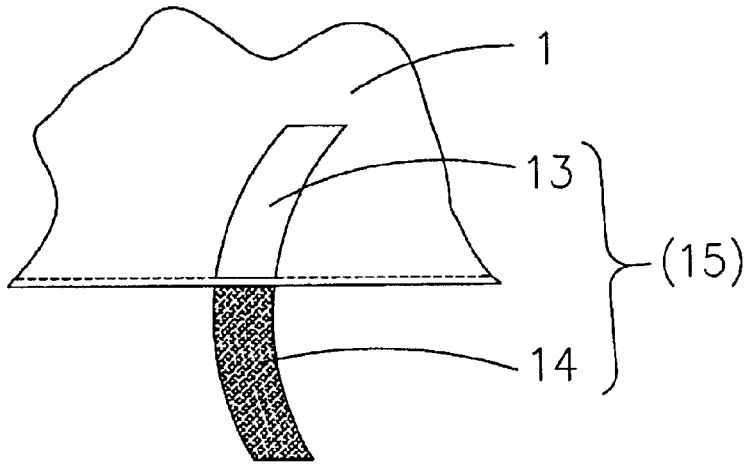
FIG. 8 is a detailed perspective view of a Velcro strap assembly with the "hook" strap and "loop" strap sewn to the bottom of the sail.

Referring now to FIGS. 2, 5, and 8, a transparent viewing window 2 is sewn to the sail along the periphery of an opening made in the sail 1. In the preferred embodiment, the sail is made of 1 ½ ounce rip stop nylon, the transparent viewing window is made of a flexible plastic material, and the sewing is done with standard sail thread. The transparent viewing window 2 must be sewn into the sail 1 low enough to permit the occupants to see the horizon while sailing the kayak 17 and should be centered with respect to the width of the sail 1. A securing assembly 12 is sewn on to each corner of the sail. Each securing assembly includes a sewn-on fabric loop 9, a nylon-covered elastic band 10, and a securing hook 11. The securing assemblies 12 at the top corners of the sail 1 serve as a means to attach the top of the sail to one end of each of the kayak paddle shafts 16. The securing assemblies 12 at the bottom corners of the sail 1 serve as a means to attach the bottom of the sail 1 to the boomstick assembly 8. Two Velcro strap assemblies 15 are sewn to the edge of the bottom of the sail 1. The Velcro strap assemblies 15 are located approximately ¼ of the length of the bottom of sail 1 inward from the side edges of the sail 1. The Velcro strap assemblies 15 serve as an additional means to attach the bottom of the sail 1 to the boomstick assembly 8.

Figure 3:
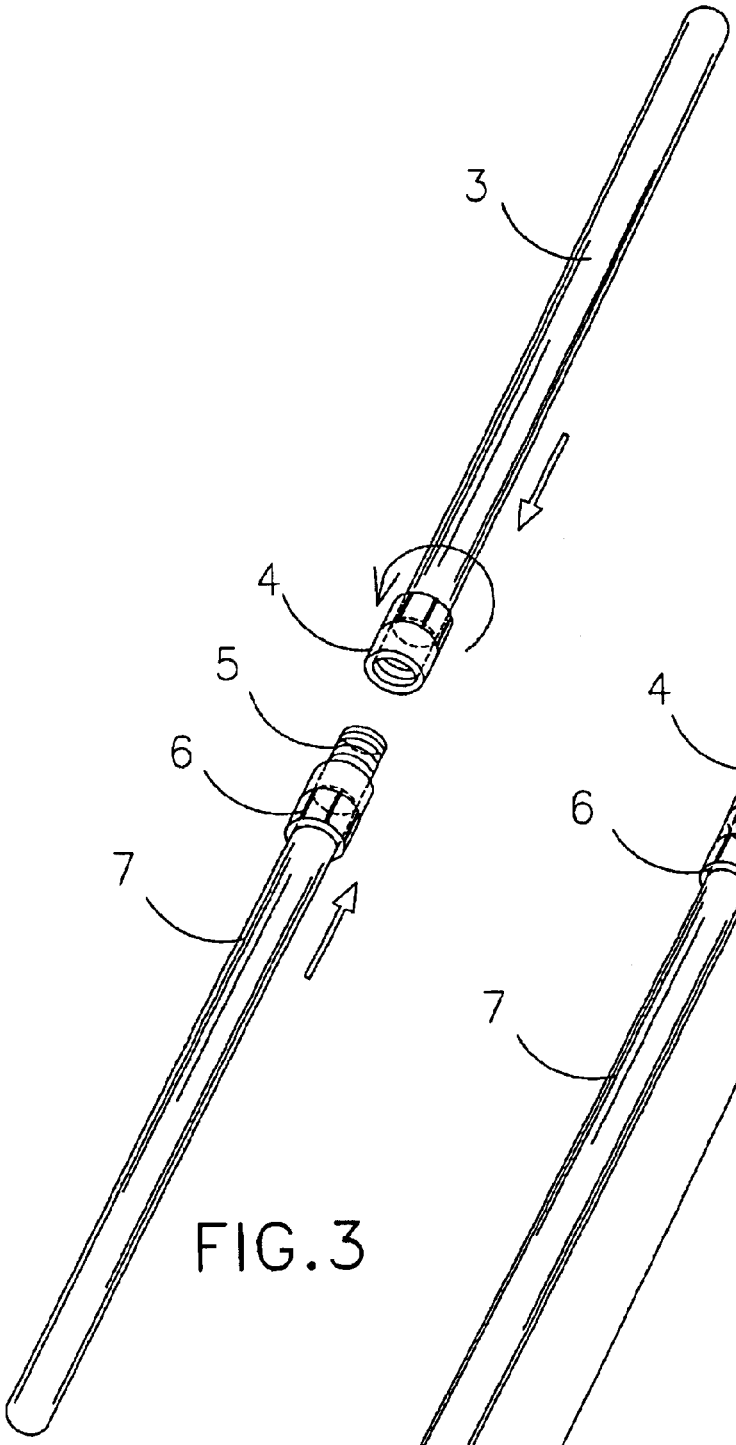
FIG. 3 is a perspective view of the unassembled halves of a boomstick as they are about to be screwed together. One unassembled half is shown with a PVC male pipe thread adaptor, the other half with a PVC female pipe thread adaptor.
Figure 4:
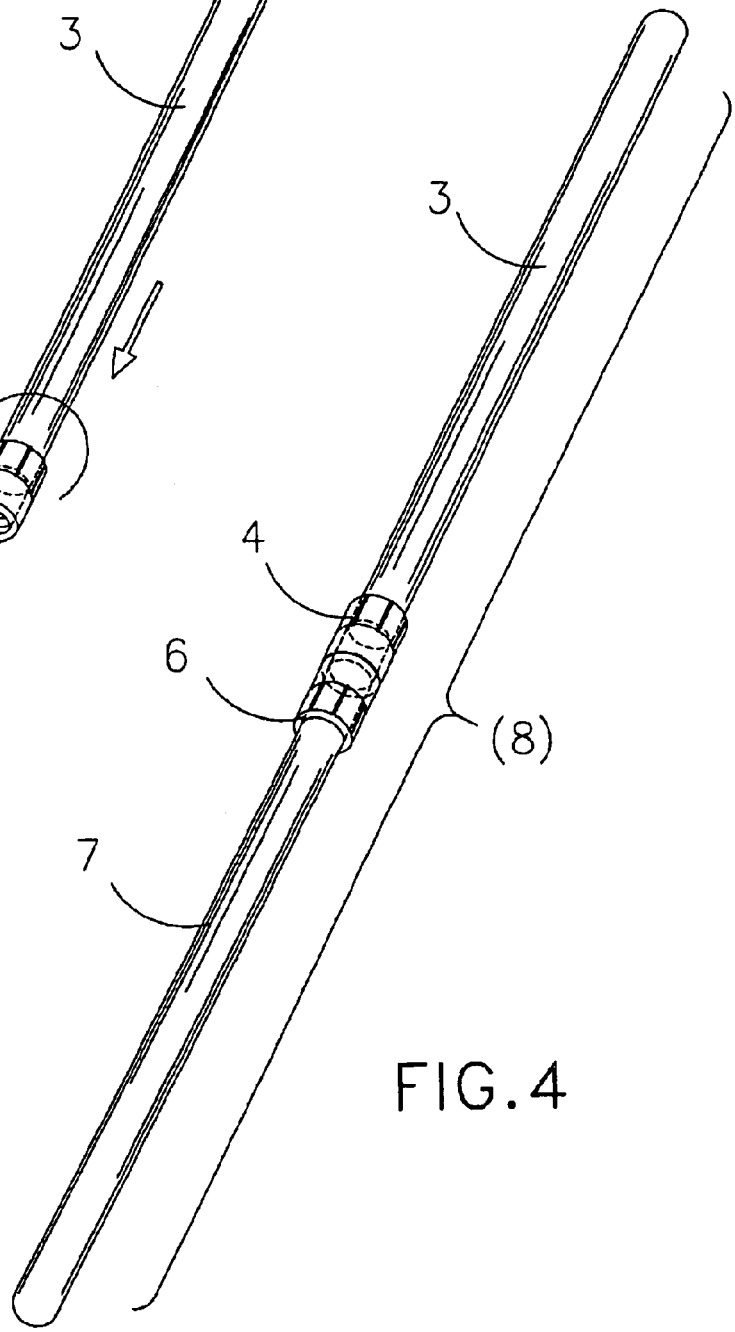
FIG. 4 is a perspective view of the assembled boomstick.

Referring now to FIGS. 3 and 4, a boomstick assembly 8 is made from two equal lengths of ¾" wooden dowel. The lengths of wooden dowel should be such that the boomstick assembly 8, when assembled as described, is approximately two inches longer than width of the bottom of the sail 1. The left boomstick rod 7 is made by gluing a ¾" slip 6 by ¾" male pipe thread 5 Polyvinyl Chloride (PVC) male adapter to one end of one length of ¾" wooden dowel. The right boomstick rod 3 is made by gluing a ¾" slip by ¾" female pipe thread PVC female adaptor 4 to one end of the other length of wooden dowel. The adaptors are glued to the dowel using cement suitable for the materials. To assemble for use, the male threads 5 of the left boomstick rod 7 are screwed into the female threads 4 of the right boomstick rod 3 to create the boomstick assembly 8.

Figure 6:
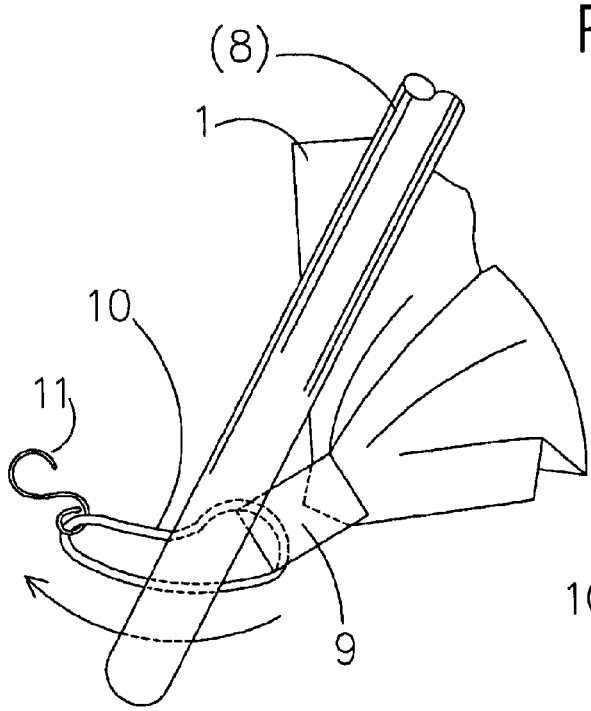
FIG. 6 is a detailed perspective view of the securing assembly as it is about to be wound around the boomstick.
Figure 7:
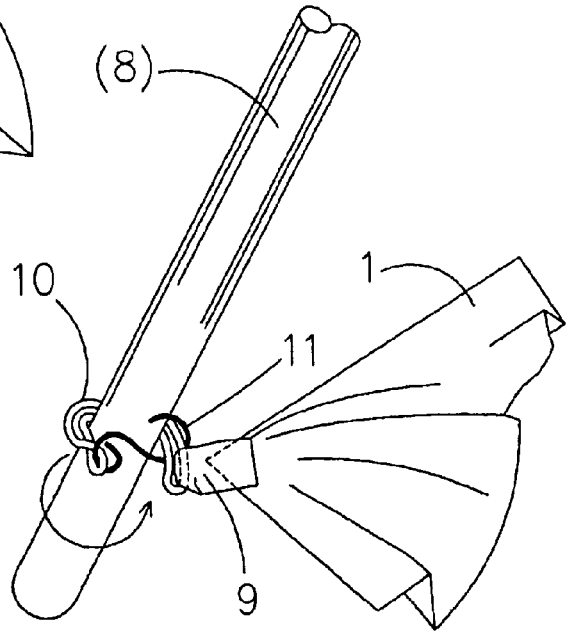
FIG. 7 is a detailed perspective view of the securing assembly in its assembled state with the nylon-covered elastic band wound one revolution around the boomstick.

Referring now to FIGS. 5, 6, and 7, a fabric loop 9 is placed within a nylon-covered elastic band 10 having a circumference such that it will wrap snugly around the boomstick. The ends of the fabric loop 9 are brought together and sewn onto a double-reinforced corner of the sail 1. The fabric loop 9 can be made from one-inch nylon or polyester webbing, a non-UV degradable material. A securing hook 11 is made by constricting one hook of a standard 1 ⅜" S-hook around the nylon-covered elastic band 9 which is already connected to a corner of the sail 1 by the fabric loop 9 as described above. Heavy pliers can be used to constrict the hook of the S-hook. To assemble for use, a nylon-covered elastic band 10 from the bottom of the sail 1 is wound one revolution around the boomstick assembly 8 approximately one inch from its end. The securing hook 10 is then clasped around both strands of the nylon-covered elastic band 10 as shown in FIG. 7.

Figure 9:
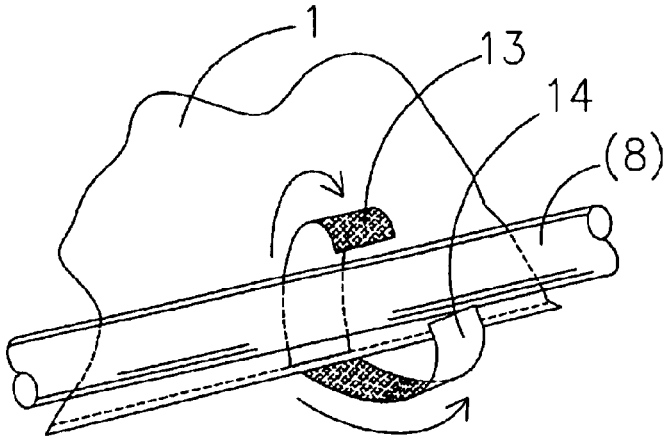
FIG. 9 is a detailed perspective view of a Velcro strap assembly with the bottom "hook" strap about to be wound over the top "loop" strap.
Figure 10:
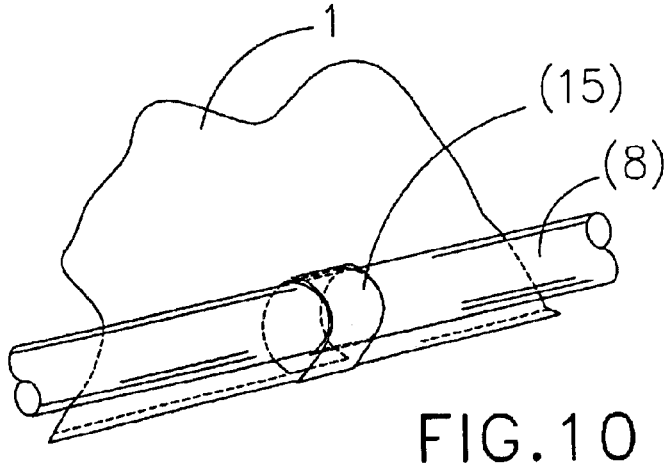
FIG. 10 is a detailed perspective view of a Velcro strap assembly in its assembled state.

Referring now to FIGS. 8, 9, and 10, a Velcro strap assembly 15 is made by sewing two straps of standard "hook-and-loop" type Velcro to the bottom of the sail such that the "hook" side of one strap will wind over the "loop" side of the other strap. Straps of the same Velcro strap assembly 15 should be sewn at the same point along the bottom of the sail. The Velcro strap assemblies 15 are located approximately ¼ of the length of the bottom of sail 1 inward from the side edges of the sail 1. To assemble for use, Velcro strap 13 is wound around the boomstick assembly 8 where it meets the boomstick assembly 8 after having secured the corners of the bottom of the sail 1 to the boomstick assembly 8 with the securing assemblies 12 as outlined above. Velcro strap 14 is wound around Velcro strap 13. This step is repeated for the other Velcro strap assembly 15. The Velcro strap assemblies 15 serve as a means to reduce the wind that can escape through the bottom of the sail 1. At this point, the bottom of the sail 1 is entirely secured to the boomstick assembly 8.

Figure 11:
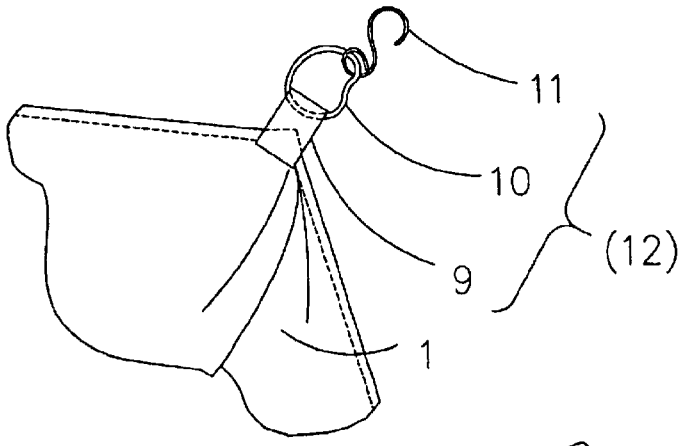
FIG. 11 is a detailed perspective view of a securing assembly at the top of the sail which includes the sewn-on fabric loop, the nylon-covered elastic band, and securing hook.
Figure 12:
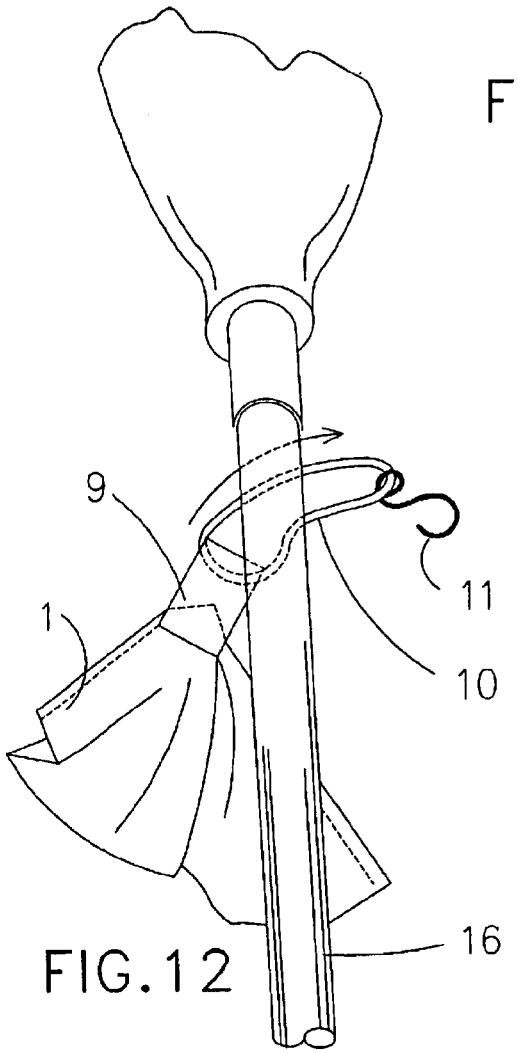
FIG. 12 is a detailed perspective view of a securing assembly as it is about to be wound around one end of the shaft of a kayak paddle.
Figure 13:
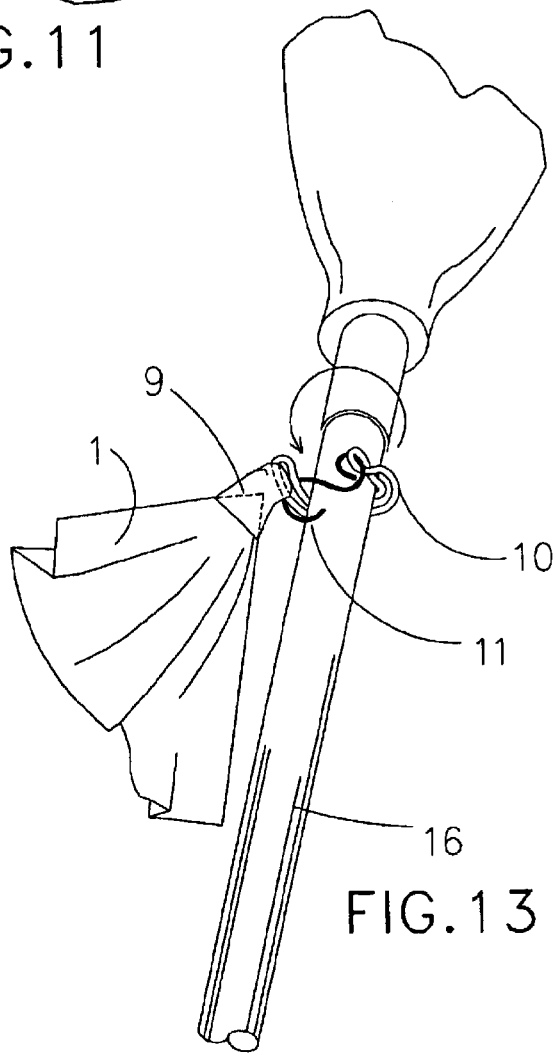
FIG. 13 is a detailed perspective view of a securing assembly in its assembled state with the nylon-covered elastic band wound one revolution around one end of the shaft of a kayak paddle.

Referring now to FIGS. 11, 12, and 13, a corner at the top of the sail 1 is attached to one end of the shaft of a kayak paddle 16 by winding a nylon-covered elastic band 10 one revolution around the end of the shaft of a kayak paddle 16 and clasping both strands of the nylon-covered elastic band 10 with the securing hook 11. Both corners at the top of the sail 1 are attached to shaft ends of the kayak paddles 16 in this manner. The fabric loop 9, nylon-covered elastic band 10, and securing hook 11 are assembled in the same way as the corresponding parts found in the securing assemblies 12 at the bottom of the sail 1 shown in FIG. 5. The nylon-covered elastic band 10 should have a circumference such that it will wrap snugly around the shaft ends of the kayak paddles 16.

After using the present invention, the sail 1 can be quickly detached from the shaft ends of the kayak paddles 16 and boomstick assembly 8 by unclasping the securing hooks 11 from the nylon-covered elastic bands 10 and unwrapping the Velcro securing assemblies 15. The sail 1 can be folded in thirds along its length and rolled into a cylindrical shape. The boomstick assembly 8 can be disassembled by unscrewing the left boomstick rod 7 from the right boomstick rod 3. The rolled up sail 1, with the left boomstick rod 7 and right boomstick rod 3 may be inserted into a standard 6-inch by 24-inch sail bag (not shown) for stowage. The present invention can be stowed in the sail bag onboard the kayak 17 where it will be ready for use.

While a preferred form of the invention has been described and shown in the drawings, variations in the preferred form will be apparent to those skilled in the art. Accordingly, the invention should not be construed as limited to the specific form described and shown, but instead as set forth in the following claims.

I claim:

1. A mastless kayak sail apparatus comprising:

a sail having four corners to define four sides, wherein said four sides comprises a sail top and bottom, and wherein the sail has a predetermined length and width;

a boomstick assembly having a cylindrical shape of a length slightly greater than the width of the bottom of the sail to which the boomstick assembly is attached for the support and control of the bottom of the sail;

a set of two kayak paddles each having one end of a shaft to which the top corners of the sail are attached for the support and control of the top of the sail;

a means for reducing the wind that can escape through a space between the bottom of the sail and the attached boomstick assembly;

a first attaching means affixed to the bottom of the sail to permit the fast assembly and disassembly of the bottom of the sail to the boomstick assembly; and a second attaching means affixed to the top of the sail to permit the fast assembly and disassembly of the top corners of the sail to one end of each of the kayak paddle shafts.

2. A mastless kayak sail apparatus as set forth in claim 1 in which a transparent viewing window is affixed along its outside periphery to the inside periphery of an appropriately-sized opening in said sail, the transparent viewing window being centered with respect to the width of said sail and positioned lengthwise along said sail such that the kayak occupants can see the horizon while sailing the kayak and looking through the transparent viewing window.

3. A mastless kayak sail apparatus as set forth in claim 2 in which the boomstick comprises two assembled cylindrical halves which can be disassembled for easy stowage.

* * * * *